US012385325B2

(12) United States Patent
Clark et al.

(10) Patent No.: US 12,385,325 B2
(45) Date of Patent: Aug. 12, 2025

(54) DRILL BIT WITH AUXILIARY CHANNEL OPENINGS

(71) Applicant: Ulterra Drilling Technologies, L.P., Fort Worth, TX (US)

(72) Inventors: Jared Clark, Fort Worth, TX (US); Charles H. S. Douglas, III, Fort Worth, TX (US); Thomas Simatic, Fort Worth, TX (US); Jeremiah Torres, Fort Worth, TX (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 0 days.

(21) Appl. No.: 17/123,254

(22) Filed: Dec. 16, 2020

(65) Prior Publication Data

US 2021/0180408 A1 Jun. 17, 2021

Related U.S. Application Data

(60) Provisional application No. 62/949,226, filed on Dec. 17, 2019.

(51) Int. Cl.

| | |
|---|---|
| ***E21B 10/60*** | (2006.01) |
| ***E21B 10/43*** | (2006.01) |
| ***E21B 10/55*** | (2006.01) |

(52) U.S. Cl.

CPC ..... *E21B 10/602* (2013.01); *E21B 10/43* (2013.01); *E21B 10/55* (2013.01); *E21B 10/60* (2013.01)

(58) Field of Classification Search

CPC ..... E21B 10/602

See application file for complete search history.

(56) References Cited

U.S. PATENT DOCUMENTS

| | | | | |
|---|---|---|---|---|
| 2,634,101 A * | 4/1953 | Sloan | E21B 41/0078 175/324 |
| 3,215,215 A * | 11/1965 | Kellner | E21B 10/60 175/405.1 |
| 4,083,417 A * | 4/1978 | Arnold | E21B 10/18 175/339 |
| 4,463,220 A * | 7/1984 | Gonzalez | E21B 10/083 175/322 |

(Continued)

FOREIGN PATENT DOCUMENTS

| | | |
|---|---|---|
| CN | 201221317 Y | 4/2009 |
| CN | 104024557 A | 9/2014 |

(Continued)

OTHER PUBLICATIONS

Dictionary definition of "adjacent", accessed Jun. 21, 2022 via thefreedictionary.com.*

(Continued)

*Primary Examiner* — Blake Michener

(74) *Attorney, Agent, or Firm* — Kilpatrick Townsend & Stockton LLP

(57) ABSTRACT

Provided herein is PDC drill bits for engaging subterranean formations and for drilling wellbores, wherein the PDC drill bits are adapted to reduce erosion of the drill bit face by the inclusion of openings in a portion of the gauge of the PDC drill bit. The present disclosure also relates to systems and methods of drilling subterranean formations using the drill bits disclosed herein.

19 Claims, 6 Drawing Sheets

(56) References Cited

U.S. PATENT DOCUMENTS

| | | | | |
|---|---|---|---|---|
| 4,515,227 | A * | 5/1985 | Cerkovnik | E21B 10/26 175/385 |
| 4,618,010 | A | 10/1986 | Falgout et al. | |
| 4,792,001 | A | 12/1988 | Zijsling | |
| 5,699,868 | A | 12/1997 | Caraway et al. | |
| 5,904,213 | A * | 5/1999 | Caraway | E21B 10/003 175/393 |
| 8,302,703 | B2 * | 11/2012 | Rolovic | E21B 7/065 175/408 |
| 2010/0147594 | A1 * | 6/2010 | Ben Lamin | E21B 10/60 175/340 |
| 2010/0218999 | A1 * | 9/2010 | Jones | E21B 10/633 175/413 |
| 2012/0043087 | A1 * | 2/2012 | Torres | E21B 10/602 166/311 |
| 2015/0008043 | A1 | 1/2015 | Clausen et al. | |
| 2015/0060150 | A1 | 3/2015 | Da Silva et al. | |
| 2018/0002986 | A1 | 1/2018 | Zhang et al. | |
| 2018/0230753 | A1 * | 8/2018 | Omidvar | E21B 10/265 |
| 2019/0284887 | A1 | 9/2019 | Casad et al. | |
| 2020/0056454 | A1 * | 2/2020 | Instone | E21B 10/602 |

FOREIGN PATENT DOCUMENTS

| | | | |
|---|---|---|---|
| CN | 205638243 | | 10/2016 |
| CN | 109611030 | | 4/2019 |
| CN | 110374515 | A * | 10/2019 |
| WO | 2016161028 | A1 | 10/2016 |

OTHER PUBLICATIONS

SLB Glossary entries for "polycrystalline diamond compact bit" and "mud", accessed Jul. 10, 2023 via glossary.slb.com.*

International Application No. PCT/US2020/065196, International Search Report and the Written Opinion, Mailed On Feb. 8, 2021, 12 pages.

International No. PCT/US2020/065196, "International Preliminary Report on Patentability", Jun. 30, 2022, 8 pages.

Canadian Application No. CA3,159,674 , Office Action, Mailed On Feb. 2, 2024, 4 pages.

European Application No. EP20838849.6, "Office Action", mailed Jun. 15, 2023, 4 pages.

Canadian Application No. CA3,159,674 , Office Action, Mailed On Oct. 11, 2024, 3 pages.

* cited by examiner

DRILL BIT WITH AUXILIARY CHANNEL OPENINGS

PRIORITY

This application claims priority to U.S. Provisional Application 62/949,226, filed on Dec. 17, 2019, which is incorporated herein by reference.

FIELD

The present invention relates generally to drill bits for engaging subterranean formations and for drilling wellbores. More specifically, the present disclosure relates to polycrystalline-diamond compact bits adapted to reduce erosion of the drill bit face. The present disclosure also relates to methods of drilling subterranean formations using the drill bits disclosed herein.

BACKGROUND

Polycrystalline-diamond compact (PDC) bits are a type of rotary drill bit used for boring through subterranean formations, e.g., when drilling wellbores for oil and/or natural gas. As a PDC bit is rotated, discrete cutting structures affixed to the face of the bit engage with the rock walls at the bottom of the well, scraping or shearing the formation. PDC bits use cutting structures, referred to as "cutters," each having a cutting surface or wear surface comprised of a PDC, hence the designation "PDC bit." Each PDC cutter is a discrete piece, separate from the drill bit, and is fabricated by bonding a layer of polycrystalline diamond, sometimes called a crown or diamond table, to a substrate. PDC, though very hard and abrasion resistant, tends to be brittle. The substrate, while still very hard, is tougher, thus improving the impact resistance of the cutter. The substrate is typically made long enough to act as a mounting stud, e.g., by fitting a portion into a pocket or recess formed in the body of the bit. In some designs, the PDC and/or the substrate structure are attached to a metal mounting stud. Because of the processes used for fabricating the PDC cutter, the cutting surface and substrate typically have a cylindrical shape, with a relatively thin diamond table bonded to a taller or longer cylinder of substrate material. The resulting composite can be machined or milled to change its shape. However, the PDC layer and substrate are most often used on PDC bits in the cylindrical form in which they are made.

Each PDC cutter of a rotary drag bit may be positioned and oriented on a face of the drag bit so that at least a portion of the cutting surface engages the subterranean formation as the bit is being rotated. The PDC cutters are spaced apart on an exterior cutting surface or face of the body of a drill bit. The PDC cutters are typically arrayed along each of several blades, which are raised ridges extending generally radially from the central axis of the bit, toward the periphery of the face. The PDC cutters along each blade present a predetermined cutting profile to the subterranean formation, shearing the formation as the bit rotates.

A drilling fluid, such as drilling mud or a pneumatic fluid, may be pumped down the drill string, into a central passageway formed in the center of the bit, and then out through openings formed in the face of the bit. Drilling fluid can serve many purposes. For example, the drilling fluid may be used to cool, lubricate, or otherwise the cutters or other components of the drill string, to remove and carry cuttings from the well, to suspend and release cuttings, to seal formations, to transmit hydraulic energy to the tools, to convey measurements to the surface, to control corrosion, and/or to facilitate cementing.

Many conventional drilling methods use liquid drilling fluids (i.e., hydraulic fluids) that are generally incompressible when employing PDC bits due to erosion issues. Other drilling methods use air-based fluids (i.e., pneumatic fluids) as the drilling fluid, which typically involves the combination of stable, competent formations, and relatively low formation pressures. Air-based fluids (i.e., pneumatic fluids) are often used, for example, in mining and blast hole drilling.

While drilling fluid is an important aspect of downhole drilling and serves numerous desirable purposes, it has been found that drilling fluid also has negative effects. In particular, drilling fluid can cause severe erosion on the drill bit and/or the PDC cutters of the drill bit. Such erosion is undesirable, because it can reduce the operable life of a drill bit and/or may contribute to failure of the drilling system altogether.

Furthermore, it has been found that some drilling fluid mixtures, in particular pneumatic fluids, present an especially high risk of bit erosion. The reduced fluid lubricity of pneumatic fluids, for example, causes heat and vibration structural damage to the drill bit and the PDC cutters. Vibrational and thermal stresses on the matrix body can result in the initiation and growth of damage to the drill bit. More specifically, severe erosion can occur in cutter substrate or at the base of blades of the drill bit, which can lead to cutter failure and/or blade failure. For example, cracks may form on the PDC cutters and may cause the separation of a portion of the cutting face from the substrate, rendering the PDC cutters ineffective or resulting in PDC cutter failure. When this happens, drilling operations may have to cease to allow for recovery of the drag bit and for replacement of the ineffective or failed cutting element. The vibrational and thermal stresses can also result in delamination of an ultra-hard layer at the interface.

In addition, erosion due to drilling fluids can contribute to cutter substrate erosion. Cutter substrate erosion is a particularly costly problem. During typical operation, the cutter face may slowly dull or erode as a result of, e.g., conventional wear. So long as the cutter includes a sharp cutting edge around a substantial portion of the circumference (e.g., about one-third of the circumference), the cutter can still be used without issue. For example, a lightly worn cutter can be rotated on the drill be to expose a fresh, sharp edge. Cutter substrate erosion prevents this. As the substrate of the cutter becomes damaged, it cannot be securely fixed (e.g., brazed) to the drill bit. As a result, the cutter must be discarded well before its face becomes dull. This reduced life greatly adds to operation costs.

Thus, the need exists for drill bits that can reduce stresses and erosion imposed during drilling to improve operating life. Additionally, the need exists for PDC bits that cut efficiently at designed speed, flow rates, and drilling conditions in downhole drilling environments to regulate the amount of cutting load in changing formations.

SUMMARY

The present disclosure relates to a drill bit comprising a body comprising a gauge for engaging a side of a well bore and a face for engaging a bottom of the well bore; a plurality of channels formed in the body, wherein the plurality of channels extend radially along a portion of the face and extend longitudinally along a portion of the gauge; a central pathway formed through the body for providing a fluid to the plurality of channels; a second opening located in at least one of the plurality of channels within the portion of the gauge, wherein the second opening is in fluidic communication with the central pathway through a second bypath; a first opening located in at least one of the plurality of channels within the portion of the face, wherein the first opening is in fluidic communication with the central pathway through a first bypath; and a plurality of blades formed between the plurality of channels, wherein each of the plurality of blades comprise an edge on which is mounted a plurality of cutters arranged for shearing the bottom of the well bore. In some embodiments, the first opening and/or the second opening comprises a port. In some embodiments, the first opening and/or the second opening is formed in a nozzle. In some embodiments, the first bypath is directed toward the face of the bit and the second bypath is directed away from the face of the bit. In some embodiments, the second bypath is fluidically connected to the central pathway at a first junction, the central pathway has a longitudinal axis, and the second bypath has a longitudinal axis, and wherein an angle of intersection between the longitudinal axis of the central pathway and the longitudinal axis of the second bypath at the first junction is less than 90 degrees. In some embodiments, the second bypath has a longitudinal axis and the at least one of the plurality of channels within the portion of the gauge comprises a bottom wall having a longitudinal axis, and wherein an angle of intersection between the longitudinal axis of the second bypath and the longitudinal axis of the bottom wall at the second opening is less than 90 degrees. In some embodiments, the first opening and the second opening are located in the same channel.

In some embodiments, each channel of the plurality the channels comprises a width, a depth, a combination of the width and the depth, or a cross sectional area that is substantially constant within at least a portion of each of the plurality of channels In some embodiments, the width and the depth of each of the plurality of channels remains substantially constant within the portion of each of the plurality of channels. In some embodiments, the cross sectional area of each of the plurality of channels remains substantially constant within the portion of each of the plurality of channels.

The present disclosure also relates to a system for drilling a well bore, the system comprising: a drill bit comprising: a body comprising a face for engaging a bottom of the well bore being drilled and a gauge for engaging a side of the well bore being drilled; a plurality of channels formed in the body, wherein the plurality of channels extend radially along a portion the face and extend longitudinally along a portion of the gauge; a central pathway formed through the body for providing a fluid to the plurality of channels a first fluidic path comprising a first opening and a first pathway, wherein the first opening is located in at least one of the plurality of channels within the portion of the face, and wherein the first fluidic path is in fluidic communication with the central pathway; a second fluidic path comprising a second opening and a second pathway, wherein the second opening is located in at least one of the plurality of channels within the portion of the gauge, and wherein the second fluidic path is in fluidic communication with the central pathway; and a fluid source configured to provide the fluid to the first fluidic path and the second fluidic path through the central pathway. In some embodiments, the first opening and/or the second opening comprises a port. In some embodiments, the first opening and/or the second opening is formed in a nozzle. In some embodiments, the first fluidic path is directed toward the face and the second fluidic path is directed toward the gauge. In some embodiments, the first fluidic path provides a first volume of the fluid, the second fluidic path provides a second volume of the fluid, and the first fluidic path and/or the second fluidic path is structured such that a ratio of the first volume to the second volume is greater than 1. In some embodiments, the fluid comprises drilling mud. In some embodiments, the fluid comprises compressible pneumatic fluid. In some embodiments, the drill bit further comprises: a plurality of blades formed between the plurality of channels, wherein each of the plurality of blades having a leading edge on which is mounted a plurality of PDC cutters; and a plurality of inserts on the plurality of blades, wherein at least some of the plurality of inserts are positioned behind the plurality of PDC cutters, between the leading edge and a trailing edge of each of the plurality of blades.

The present disclosure also relates to a method for drilling a well bore through a subterranean formation, the method comprising: rotating a drill bit in the well bore, wherein the drill bit comprises: a body comprising a face for engaging a bottom of the well bore being drilled and a gauge for engaging a side of the well bore being drilled; a plurality of channels formed in the body, wherein the plurality of channels extends radially along a portion the face and extend longitudinally along a portion of the gauge; a plurality of blades formed between the plurality of channels, wherein each of the plurality of blades having a leading edge on which is mounted a plurality of PDC cutters a central pathway formed through the body for providing a fluid to the plurality of channels a first fluidic path comprising a first opening and a first pathway, wherein the first opening is located in at least one of the plurality of channels within the portion of the face, and wherein the first fluidic path is in fluidic communication with the central pathway; and a second fluidic path comprising a second opening and a second pathway, wherein the second opening is located in at least one of the plurality of channels within the portion of the gauge, and wherein the second fluidic path is in fluidic communication with the central pathway; engaging the well bore with the plurality of PDC cutters to form rock cuttings, wherein the rock cuttings fall into the plurality of channels; and pumping the fluid to the first fluidic path and the second fluidic path through the central pathway. In some embodiments, the first fluidic path is directed toward the direction of drilling and the second fluidic path is directed opposite the direction of drilling. In some embodiments, the first fluidic path provides a first volume of the fluid, the second fluidic path provides a second volume of the fluid, and the first fluidic path and/or the second fluidic path is structured such that a ratio of the first volume to the second volume is greater than 1. In some embodiments, the fluid comprises drilling mud. In some embodiments, the fluid comprises compressible pneumatic fluid.

BRIEF DESCRIPTION OF THE DRAWINGS

The disclosure is described in detail below with reference to the appended drawings, wherein like numerals designate similar parts.

DETAILED DESCRIPTION

Introduction

Figure 1:
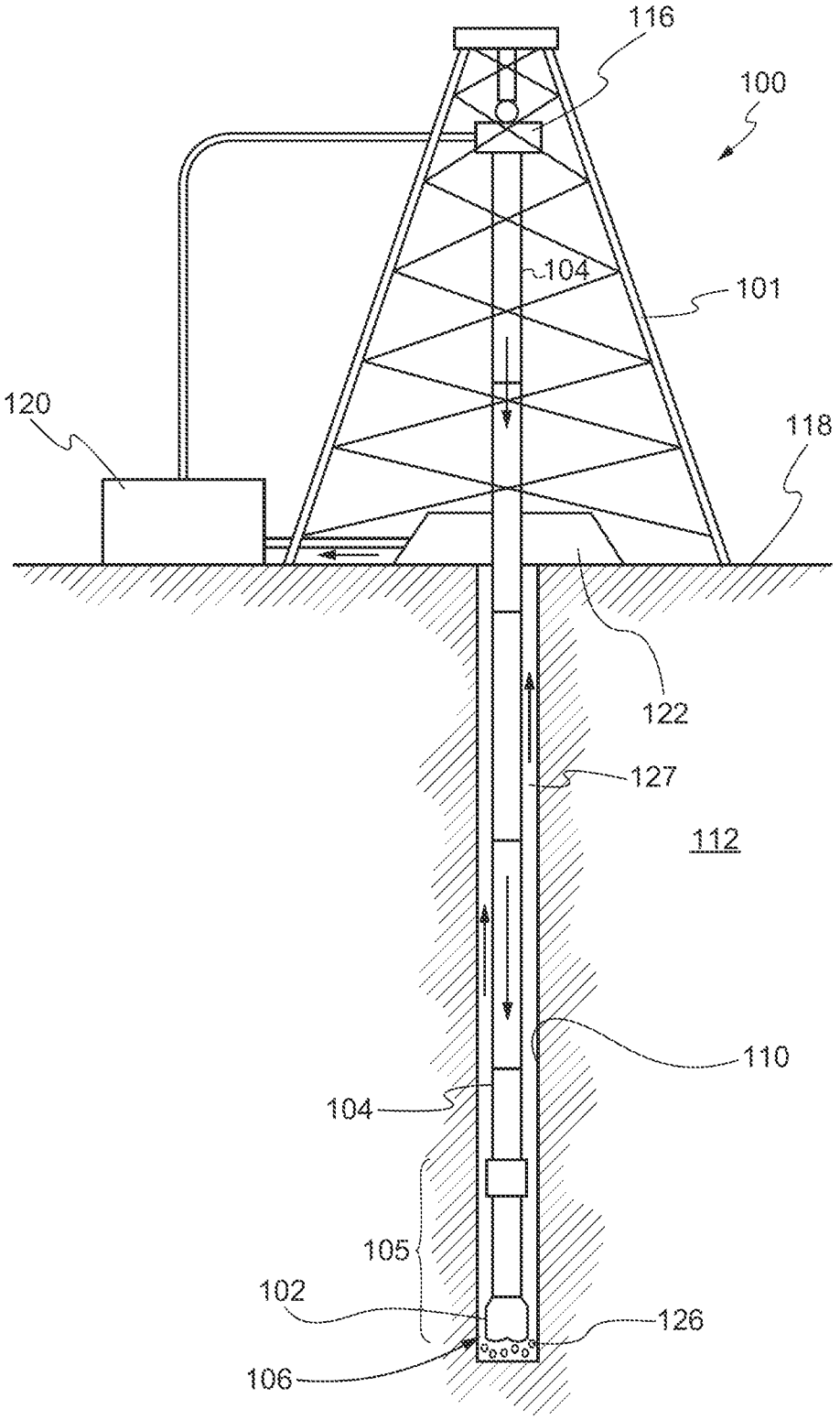
FIG. 1 is a schematic view of a downhole drilling operation in accordance with various embodiments.

Conventional downhole drilling operations utilize drilling fluid, such as drilling mud or a pneumatic fluid, to serve a number of critical downhole functions. For example, drilling fluid may be used to evacuate or "lift" the rock cuttings to the surface. During a drilling operation, the drilling fluid may be pumped down the drill string, into a central passageway formed in the center of the drill bit, and then out through openings, ports or nozzles formed in the face of the drill bit. The drilling fluid both cools the cutters and helps to remove and carry cuttings from between the blades to the surface.

There are a number of advantages and disadvantages to liquid drilling (e.g., drilling with drilling mud) and air drilling (e.g., drilling with pneumatic fluid) operations. For example, liquid drilling is useful for keeping formation water out of a drilled bore hole. Formation water is typically encountered when drilling to a subsurface target depth, and the hydrostatic pressure of the hydraulic fluid column in the annulus is sufficient to keep water from flowing out of the exposed rock formations in the borehole. Moreover, liquid drilling is useful for controlling high pore pressure typically encountered in oil, natural gas, and geothermal drilling operations. The heavier hydraulic fluid column in the annulus provides a high bottom hole pressure needed to balance (or overbalance) the high pore pressure from a deposit of a natural resource such as oil or gas. However, the heavier hydraulic fluid column can be disadvantageous because it increases the confining pressure on the rock bit cutting face, which slows the drilling penetration rate. Furthermore, the high pressure and velocity at which the hydraulic fluid is pumped into the drill string and through the drill bit may imposes stress and erosion on the drill bit and on individual cutters affixed to the drill bit.

In contrast to liquid drilling, the earliest recognized advantage of air drilling is the ability to increase the drilling penetration rate. The lighter the fluid of the column in the annulus (with entrained rock cuttings), the lower the confining pressure on the rock bit cutting face. The lower confining pressure allows the rock cuttings from the rock bit to be removed more easily from the cutting face. Air drilling may also avoid formation damage, which is an important issue in fluid recovery, and avoid loss of circulation, which can result in a catastrophic sever of the drill string and bit. However, unlike conventional hydraulic fluids used in liquid drilling, the pneumatic fluids used in air drilling are compressible and are not as effective as hydraulic fluids at preventing excessive temperatures and vibrational stresses that could degrade the cutters. Furthermore, pneumatic fluids have been found to less effectively evacuate cuttings formed during drillings. As a result, operators typically run pneumatic fluids at higher flow rates (relative to hydraulic fluids) to compensate, which further contributes to cutter erosion. Specifically, previous attempts to apply PDC technology in air drilling environments have proven unsuccessful primarily due to excessively rapid cutter erosion. Air drilling thus presents a unique set of problems and challenges for PDC bits, particular those made with matrix bodies.

To address these limitations and problems, various embodiments disclosed herein are directed to drill bits developed to allow a portion of the drilling fluid pumped into the drill string and through the drill bit to bypass the face of the drill bit. In some instances, a drill bit includes a second opening (e.g., an auxiliary opening), such as a port or nozzle, formed in a gauge portion in at least one of the channels of the drill bit. The second opening is in fluidic communication with the central passageway through a second bypath. The second bypath travels from the central passageway in a direction away from the face of the drill bit (e.g., substantially opposite the direction of drilling) to the second opening in the gauge portion. The drill bit further includes a first opening (e.g., a primary opening), such as a port or nozzle, formed in at least one of the plurality of channels within the portion of the face of the drill bit. The first opening is in fluidic communication with the central passageway through a first bypath. The first bypath travels from the central passageway in a direction towards the face of the drill bit (e.g., substantially same direction of drilling) to the first opening in the face. Accordingly, drilling fluid pumped through the drill string and into the central passageway of the bit may partially flow through the second bypath and out of the second opening and partially flow through the first bypath and out the first opening. It has been surprising and/or unexpectedly found that the inclusion of the auxiliary opening greatly reduces the stress and erosion imposed on the face of the drill bit as well as the PDC cutters formed thereon.

The drill bits described herein are suitable for a variety of downhole operations, including drilling (e.g., rotary drilling with a blade bit), mining, blast hole drilling, frac completion, refracturing, reentry, or remediation. Notably, the drill bits described herein are suitable for both liquid drilling and air drilling. Generally, the auxiliary opening increases the total cross-sectional flow area ("TFA") of the drilling fluid, which reduces the velocity of the drilling fluid and thereby minimizes erosion. In liquid drilling, the reduced velocity of the drilling fluid is particularly advantageous because liquid drilling typically utilizes smaller drill bits. In air drilling, larger drill bits are typically utilized, and a minimum TFA is required. The TFA needed for air drilling conventionally required high fluid velocities and thereby serious erosion on the face of the bit. The inclusion of the auxiliary opening mitigates erosion while also meeting the minimum TFA requirement.

As used herein, the terms "substantially," "approximately" and "about" are defined as being largely but not necessarily wholly what is specified (and include wholly what is specified) as understood by one of ordinary skill in the art. In any disclosed embodiment, the term "substantially," "approximately," or "about" may be substituted with "within [a percentage] of" what is specified, where the percentage includes 0.1, 1, 5, and 10 percent.

As used herein, the term "fluidic communication" means that the components are connected to one another in a manner that allows a fluid (e.g., pneumatic or hydraulic fluid) to pass there between.

As used herein, when an action is "based on" something, this means the action is based at least in part on at least a part of the something.

Drilling Rig

As noted above, the present disclosure relates to a novel drill bit design for use in engaging subterranean formations and for drilling wellbores. The drill bits disclosed herein may be incorporated into a system for drilling and other downhole operation.

FIG. 1 is a schematic representation of a drilling rig 100 for a drilling operation. Each of the components that are shown in the schematic representation of the drilling rig 100 are intended to be generally representative of the component, and the particular example is intended to be a non-limiting, representative example of how a drilling rig might be set up for drilling with a drill bit as described herein. In various embodiments, the drilling rig 100 includes a derrick 101 that positions a drill bit 102 at the end of a drill string 104 within the hole or well bore 106 that is formed in the subterranean formation 112. During drilling operations, a drill bit 102 may be coupled to a lower end of the drill string 104. In some embodiments, the drill bit 102 comprises one or more PDC cutters comprised of sintered polycrystalline diamond (either natural or synthetic) exhibiting diamond-to-diamond bonding, polycrystalline cubic boron nitride, wurtzite boron nitride, aggregated diamond nanorods (ADN), other hard crystalline materials that may be substituted for diamond, or combinations thereof.

Drill string 104 may be several miles long and, like the well bore 106, extend in both vertical and horizontal directions from the surface 118. In this example, the drill string 104 is formed of segments of threaded pipe that are screwed together at the surface as the drill string 104 is lowered into the well bore 106. However, the drill string 104 may also comprise coiled tubing. The drill string 104 may also include components other than pipe or tubing. For example, a bottom hole assembly (BHA) 105 may be coupled to a lower end of the drill string 104 prior to the drill bit 102. The BHA 105 may include, depending on the particular application, one or more of the following components: a bit sub, a downhole motor, stabilizers, drill collar, jarring devices, directional drilling and measuring equipment, measurements-while-drilling tools, logging-while-drilling tools and other devices. The characteristics of the components of the BHA 105 contribute to determining the drilling penetration rate of the drill bit 102 and the well bore 106 shape, direction and other geometric characteristics.

During drilling, the drill bit 102 is rotated to shear the subterranean formation 112 and advance the well bore 106. The drill bit 102 may be rotated in any number of ways. For example, the drill bit 102 may be rotated by rotating the drill string 104 with a top drive 116 or a table drive (not shown) or with a downhole motor that is part of the BHA 105. The drill bit 102 may be surrounded by a sidewall 110 of the well bore 106. As the drill bit 102 is rotated within the well bore 106 via the drill string 104, a drilling fluid may be pumped down the drill string 104, through the internal passageways within the drill bit 102, and out from drill bit 102 through openings, nozzles or ports. Formation cuttings 126 generated by the one or more PDC cutters of the drill bit 102 may be carried with the drilling fluid through the channels, around the drill bit 102, and back up the well bore 106 through the annular space 127 within the well bore 106 outside the drill string 104.

The drilling fluid may be pumped down the drill string 104 using conventional means, e.g., pumps. FIG. 1 illustrates a fluid source 120, which is intended to be a non-limiting representation any of the possible ways of generating the drilling fluid (e.g., hydraulic or pneumatic fluid), as the drill bit 102 can be used with any of them. The drilling fluid is circulated down the well bore 106 by flowing it through the drill string 104, to the drill bit 102, where it exits through the openings, nozzles or ports to carry cuttings away from the face of the drill bit 102 and into the annular space 127, where the cuttings may be carried up to a collection point 122. The drilling fluid within the collection point 122 may be recirculated once cleaned of the cuttings.

In various embodiments, the drilling fluid comprises liquid drilling mud (i.e., a hydraulic fluid). Various conventional liquid drilling muds are known, and each of these is acceptable for use with the drill bits and the drilling system described herein. In some embodiments, for example, the liquid drilling mud may comprise water alone or in combination with other components. In some embodiments, the liquid drilling mud may comprise water in combination with clays (e.g., betonite) or other chemicals (e.g., potassium formate). In some embodiments, the liquid drilling mud may be an oil-based mixture, for example, comprising a petroleum product. In some embodiments, the liquid drilling mud may comprise a synthetic oil In various embodiments, the drilling fluid comprises a pneumatic fluid, e.g., a mixture of one or more gases. In some embodiments, the pneumatic fluid comprises atmospheric air (e.g., a combination of atmospheric gases). In other embodiments, the pneumatic fluid comprises one or more gases from storage tanks (such as liquid nitrogen) that is then vaporized to create high pressure gas, which may or may not be further compressed. In other embodiments, the air is a combination of atmospheric gases and additional gases such as inert gases, e.g., argon or helium. In some embodiments, the pneumatic fluid is pressurized before flowing through the drill pipe. The pressurized pneumatic fluid can be generated in any number of ways, any of which may be used with the drill bit 102. For example, the fluid source 120 may comprise one or more high pressure pumps that compresses the air.

Drill Bit

The present disclosure relates to a drill bit structurally modified to reduce erosion of the PDC cutters and/or the face of the drill bit. In particular, the present disclosure relates to PDC drill bits having an opening in the gauge of the drill bit. This additional opening, as described in detail below, allows a portion of the drilling fluid to bypass the face of the drill bit, thereby reducing the erosion of the PDC cutters and/or the face.

The drill bits of the present disclosure comprise a body, comprising a gauge for engaging a side of a well bore and a face for engaging a bottom of the well bore; a plurality of channels formed in the body, where the plurality of channels extend radially along a portion of the face and extend longitudinally along a portion of the gauge; a central pathway formed through the body for providing a fluid to the plurality of channels; a second opening located in at least one of the plurality of channels within the portion of the gauge, where the second opening is in fluidic communication with the central pathway through a second bypath; a first opening located in at least one of the plurality of channels within the portion of the face, where the first opening is in fluidic communication with the central pathway through a first bypath; and a plurality of blades formed between the plurality of channels, where each of the plurality of blades comprise an edge on which is mounted a plurality of cutters arranged for shearing the bottom of the well bore.

Figure 2A:
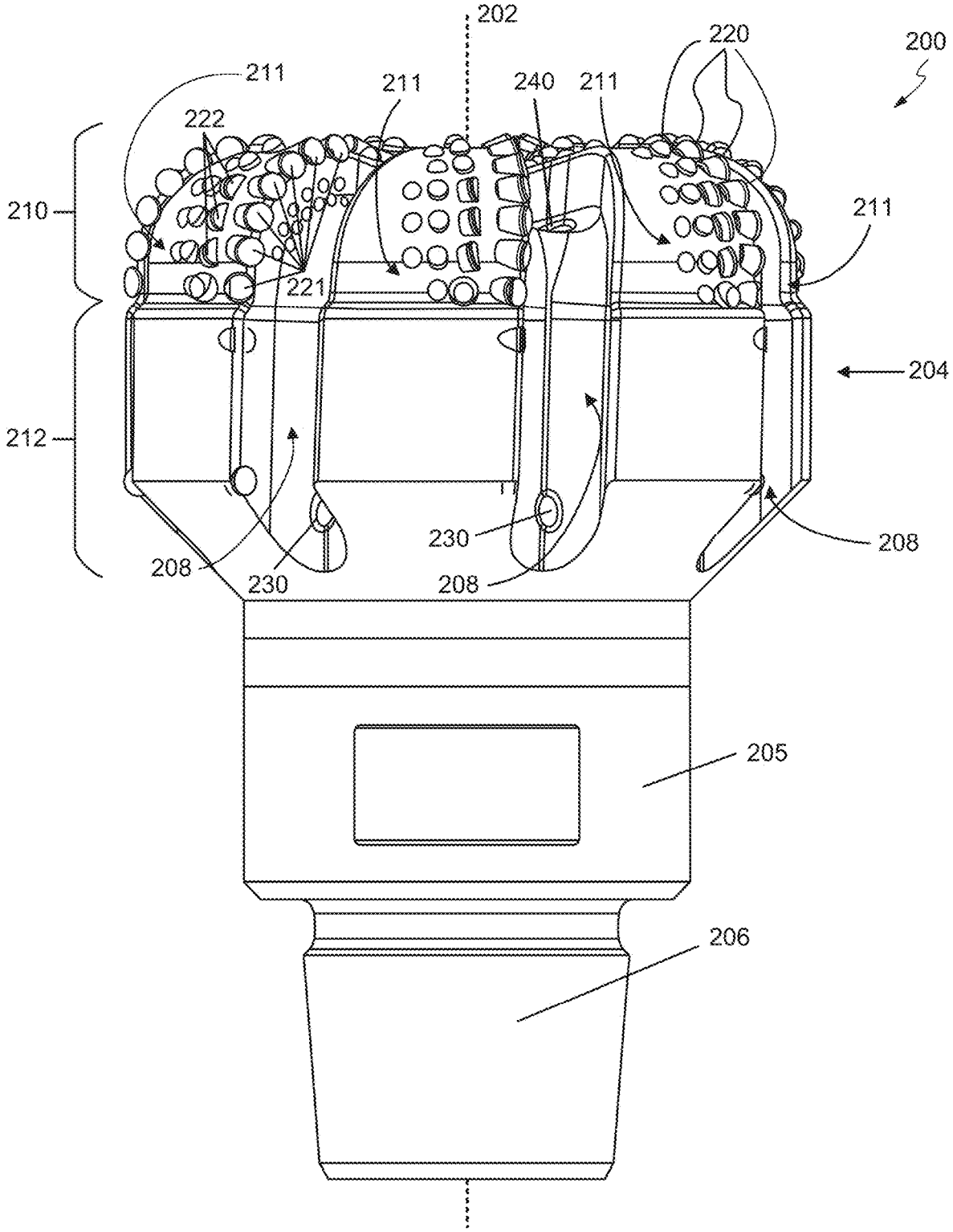
FIG. 2A is a side view of a drill bit in accordance with various embodiments of the present disclosure.
Figure 2B:
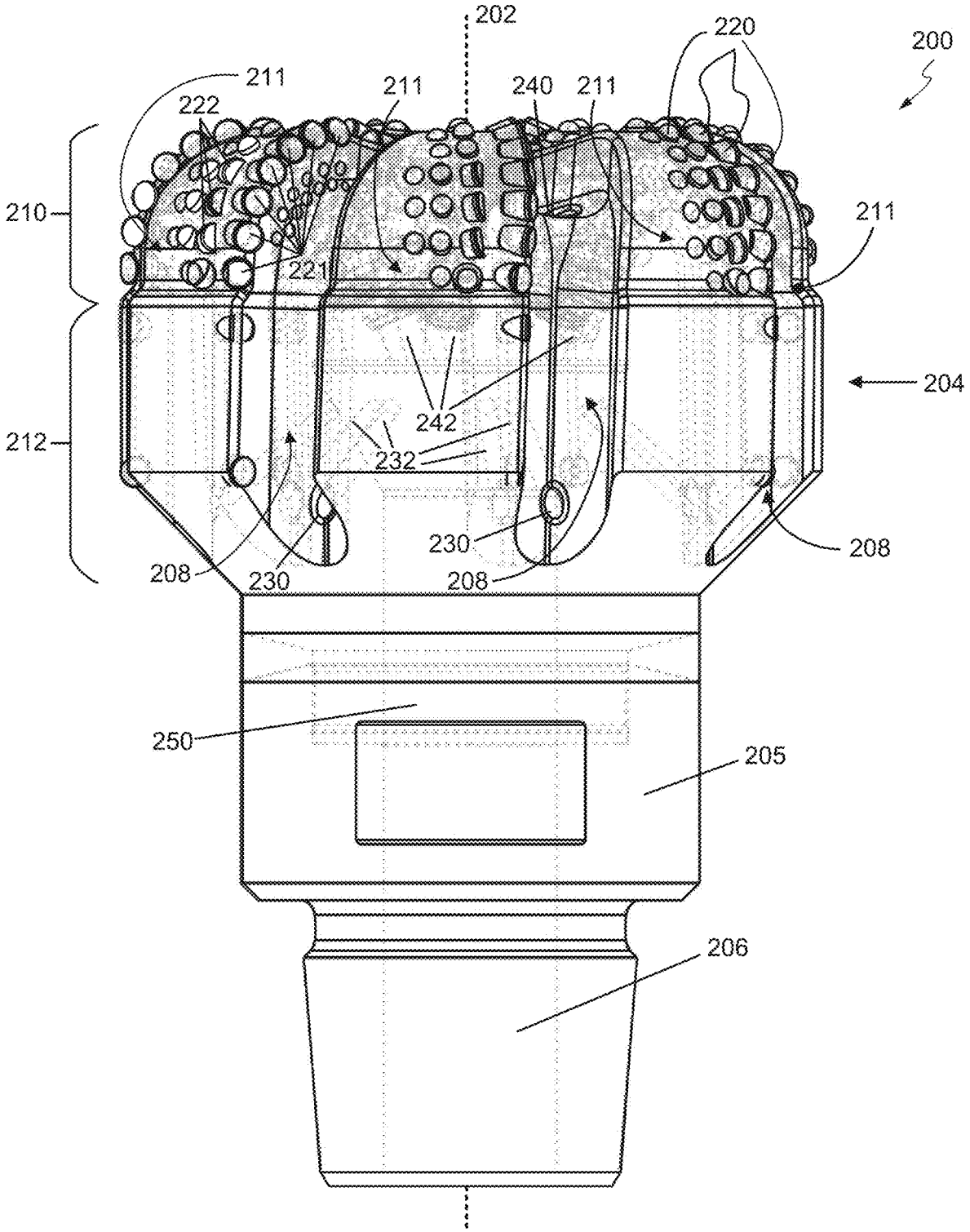
FIG. 2B is a side view of a drill bit in accordance with various embodiments of the present disclosure, wherein internal features of the drill bit are depicted with dashed lines.

FIGS. 2A and 2B illustrate an embodiment of the drill bit of the present disclosure. In particular, FIGS. 2A and 2B illustrate a drill bit 200 (e.g., the drill bit 104 as described with respect to FIG. 1) structurally adapted to reduce erosion of the face. The drill bit 200 is intended to be a representative example of drill bits, e.g., PDC drag bits, for drilling of subterranean formations. The drill bit 200 is designed structurally and mechanically to be rotated around its central axis 202. As shown, the drill bit 200 comprises a body 204 connected to a shank 205 having a tapered threaded coupling 206 for connecting the drill bit 200 to a drill string (not shown in FIG. 2A or FIG. 2B but as described with respect to FIG. 1). The body 204 is not limited to any particular material. In some embodiments, the body 204 is made from an abrasion-resistant composite material or "matrix" comprising, for example, powdered tungsten carbide cemented by metal binder.

As shown, the body 204 is disposed radially around the central axis 202, which the body 204 is intended to rotate about during the drilling process. As shown in FIGS. 2A and 2B, the body 204 includes a face 210 that is intended to engage a bottom end of the well bore being drilled. In the embodiment shown in the figures, the face 210 substantially lies in a plane perpendicular to the central axis 202 of the drill bit 200. The body 204 also includes a gauge 212 that is intended to engage side wall of the well bore being drilled. In the embodiment shown in the figures, the gauge 212 substantially lies in plane parallel to the central axis 202 of the drill bit 200. The drill bit 200 further includes a plurality of channels 208 formed in the body 204, extending along a portion of the face 210 and along a portion of the gauge 212. Formed between the channels 208 is a plurality of blades 211.

In the drill bit 200, the cutting elements 220 may be placed along the forward (in the direction of intended rotation) side of the blades 211, with their working surfaces facing generally in the forward direction for shearing the subterranean formations when the drill bit 200 is rotated about its central axis 202. In some embodiments, the blade 211 may comprise one or more rows of cutting elements 220 disposed on the blade 211. In some embodiments, the PDC drill bit 200 has both a first row of PDC cutters 221 (i.e., a subset of the cutting elements 220) and a second row of PDC cutters 222 (i.e., another subset of the cutting elements 220) mounted on each of the blades 211. The first row of PDC cutters 221 may be primary cutters and the second row of PDC cutters may be secondary or backup cutters. Furthermore, the primary cutters may be single set or a plural set (e.g., multiple rows of cutters).

Second Opening

The drill bits of the present disclosure include a second opening (e.g., an auxiliary opening) located within the portion of the gauge of at least one of the plurality of channels. In this location, the second opening, and the second bypath to which it connects, provides a pathway for drilling fluid such that the drilling fluid can bypass the face of the drill bit. In the embodiments shown in FIGS. 2A and 2B, the drill bit 200 includes second openings 230 formed in the gauge 212. As can be seen in FIG. 2B, in particular, the drill bit 200 comprises a central pathway 250, which runs through the body. The central pathway 250 is connected to each second opening 230 via a second bypath 232. The central pathway 250, through the second bypath 232 and the first bypath 242, is intended to provide drilling fluid to the channels 208.

In some embodiments, the drill bit comprises one auxiliary opening. In other embodiments, the drill bit may comprise a plurality of auxiliary openings. For example, the drill bit may comprise at least one auxiliary opening, e.g., at least two auxiliary openings, at least three auxiliary openings, four auxiliary openings, or at least five auxiliary openings.

In some embodiments, the drill bit comprises a second opening in each channel of the plurality of channels. In one such embodiment, for example, the drill bit comprise four channels formed in the body of the drill bit, and each of the four channels comprises a second opening formed in a portion of the gauge. In some of these embodiments, each channel of the plurality may comprise one second opening. In some of these embodiments, each channel of the plurality of channels may comprise at least one second opening, e.g., at least two second openings, at least three second openings, four second openings, or at least five second openings. In the embodiment shown in FIGS. 2A and 2B, for example, the drill bit 200 includes one second opening 230 formed in each channel.

The nature and structure of the auxiliary opening is not particularly limited. In some embodiments, the auxiliary opening is a port. In some embodiments, the auxiliary opening is part of a nozzle. In some embodiments, the drill bit comprises a plurality of auxiliary openings, and each auxiliary opening is a port. In some embodiments, the drill bit comprises a plurality of auxiliary openings, and each auxiliary opening is part of a nozzle. In some embodiments, the drill bit comprises a plurality of auxiliary openings, each auxiliary opening independently is a port or part of a nozzle. In the embodiments shown in FIGS. 2A and 2B, for example, each second opening 230 is in the form of a port.

In the drill bits of the present disclosure, the second opening (e.g., the auxiliary opening) is in communication with the central pathway of the drill bit through a second bypath. Each of the second bypath and the central pathway has a longitudinal axis, which runs through the center of the second bypath and the central pathway, respectively. Similarly, the second opening may be located on the bottom wall of the gauge portion of a channel, and the bottom wall may comprise a longitudinal axis. The second bypath, central pathway, and/or the bottom wall of the channel are preferably structured such that the second bypath is generally directed toward the gauge and substantially away from the face of the drill bit.

In some embodiments, for example, the second bypath and central pathway may be structured such that the longitudinal axis of the second bypath and the longitudinal axis of the central pathway intersect at a specific angle. In one embodiment, the angle of intersection between the longitudinal axis of the second bypath and the longitudinal axis of the central pathway is less than 90 degrees, e.g., less than 80 degrees, less than 70 degrees, or less than 60 degrees. In terms of lower limits, the angle of intersection between the longitudinal axes may be greater than 0 degrees, e.g., greater than 5 degrees, greater than 10 degrees, greater than 15 degrees, or greater than 20 degrees. In terms of ranges, the angle of intersection between the longitudinal axes may be from 0 to 90 degrees, e.g., from 10 to 80 degrees, from 20 to 70 degrees, or from 30 to 60 degrees.

In some embodiments, for example, the second bypath and bottom wall may be structured such that the longitudinal axis of the second bypath and the longitudinal axis of the bottom wall intersect at a specific angle. In one embodiment, the angle of intersection between the longitudinal axis of the second bypath and the longitudinal axis of the bottom wall is less than 90 degrees, e.g., less than 80 degrees, less than 70 degrees, or less than 60 degrees. In terms of lower limits, the angle of intersection between the longitudinal axes may be greater than 0 degrees, e.g., greater than 5 degrees, greater than 10 degrees, greater than 15 degrees, or greater than 20 degrees. In terms of ranges, the angle of intersection between the longitudinal axes may be from 0 to 90 degrees, e.g., from 10 to 80 degrees, from 20 to 70 degrees, or from 30 to 60 degrees.

The shape of the second bypath is not particularly limited, and any suitable shape may be utilized. In some embodiments, the second bypath is substantially straight. In some embodiments, the second bypath is curved. In some embodiments, the second bypath has a cross-section that is selected from the group consisting of circular, substantially circular, crenulated, ovular, substantially ovular, polygonal, substantially polygonal, dog-bone, "Y," "X," "K," "C," multi-lobe, and any combination thereof.

Figure 3:
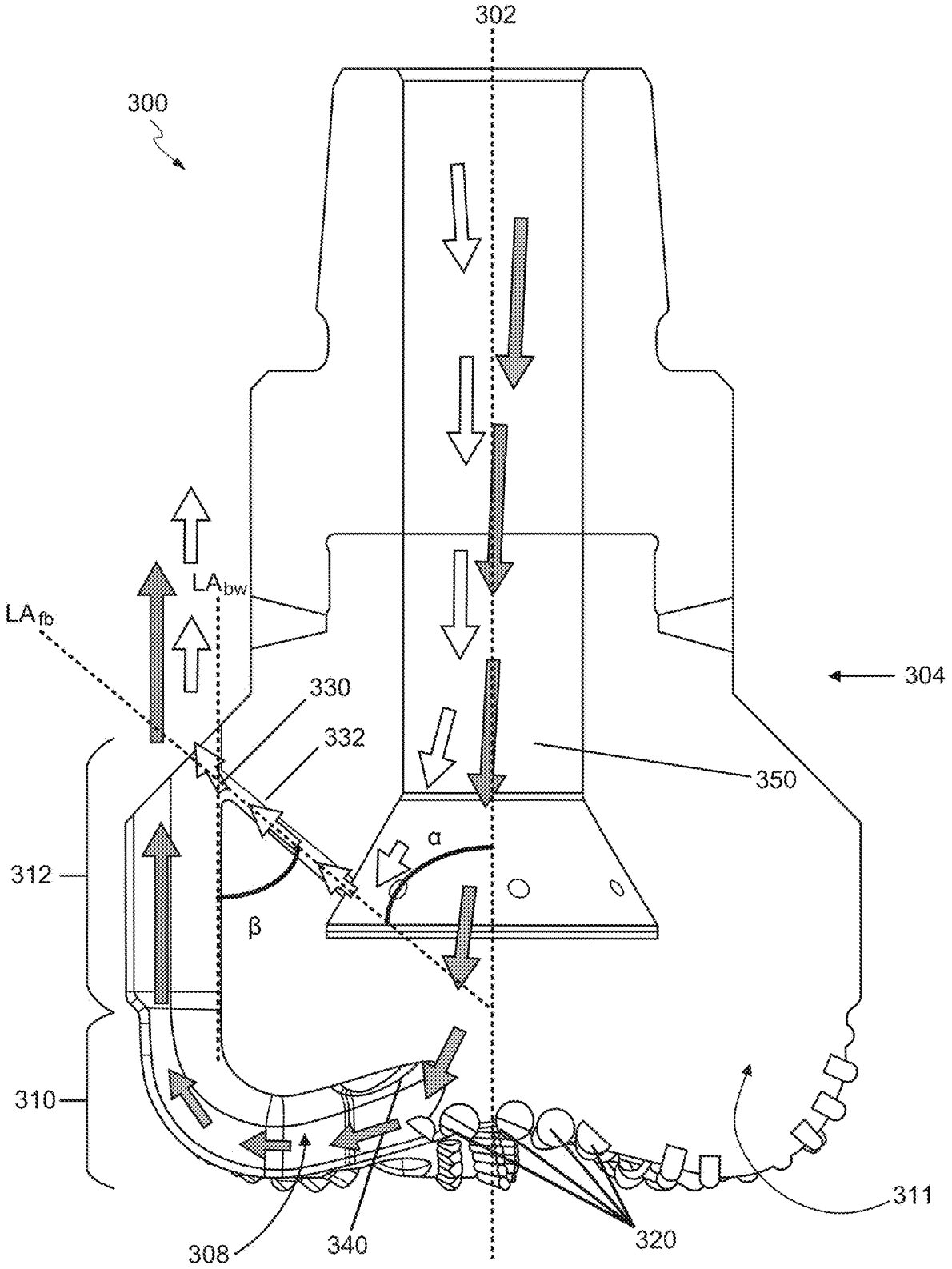
FIG. 3 is a cross-sectional view of a drill bit in accordance with various embodiments of the present disclosure.

The structure and orientation of the second bypath can be seen in FIG. 3, which depicts the cross-section of an embodiment of the drill bit of the present disclosure. As shown, the drill bit 300 comprises a body 304 disposed radially around the central axis 302, which the body 304 is intended to rotate about during the drilling process. The body 304 includes a face 310 that is intended to engage a bottom end of the well bore being drilled and a gauge 312 that is intended to engage side wall of the well bore being drilled. FIG. 3 depicts the cross-section of one channel 308 formed in the body 304, extending along a portion of the face 310 and along a portion of the gauge 312, as well as depicts the cross-section of one blade 311. The drill bit 300 also includes cutting elements 320 for shearing the subterranean formations when the drill bit 300 is rotated about its central axis 302

As can be seen in FIG. 3, the drill bit 300 comprises a central pathway 350, which runs through the body. The central pathway 350 is connected to a second opening 330 via a second bypath 332. The central pathway 350, in part through the second bypath 332 and the first bypath, is intended to provide drilling fluid to the channels 308.

In FIG. 3, arrows illustrate the typical direction of drilling fluid flow during operation. The arrows demonstrate how the second bypath 332 is structured to allow the drilling fluid to bypass the face of the bit. The second bypath 332 is directed toward the gauge 312. During drilling, the second bypath 332 is directed opposite the direction of drilling. In particular, the second bypath is structured such that the longitudinal axis $LA_{fb}$ of the second bypath 332 intersects with the longitudinal axis of the central pathway (which corresponds to the central axis 302 in this embodiment) at an angle $\alpha$, which is less than 90 degrees. Furthermore, the second bypath is structured such that the longitudinal axis $LA_{fb}$ of the second bypath 332 intersects with the longitudinal axis $LA_{bw}$ of a bottom wall of the channel 308 at an angle $\beta$, which is less than 90 degrees.

First Opening

As noted, the drill bits of the present disclosure include a first opening (e.g., a primary opening), located within the portion of the face of at least one of the plurality of channels. In this location, the primary opening, and the primary bypath to which it connects, provides a pathway for drilling fluid such that the drilling fluid can reach the face of the drill bit. The drilling fluid can therefore be used to serve, e.g., cool, the cutters formed on the face of the drill and to help remove and carry away rock cuttings from between the blades. In the embodiment shown in FIGS. 2A and 2B, for example, the drill bit 200 includes first openings 240 formed in the face 210. As can be seen in FIG. 2B, in particular, the drill bit comprises a central pathway 250, which runs through the body. The central pathway 250 is connected to each first opening 240 via first bypath 242. The central pathway 250, in part through the first bypath 242, is intended to provide drilling fluid to the channels 208.

In some embodiments, the drill bit comprises one primary opening. In other embodiments, the drill bit may comprise at least one primary opening, e.g., at least two primary openings, at least three primary openings, four primary openings, or at least five primary openings. In some embodiments, the number of primary openings corresponds to the number of auxiliary openings, e.g., one primary opening for each auxiliary opening, two primary openings for each auxiliary opening, or one primary opening for each two auxiliary openings. In the embodiment shown in FIGS. 2A and 2B, for example, the drill bit 200 includes one first opening 240 formed in a portion of the face 210 of each channel 208.

In some embodiments, the drill bit comprises a primary opening in each channel of the plurality of channels. In one such embodiment, for example, the drill bit comprise four channels formed in the body of the drill bit, and each of the four channels comprises a primary opening formed a portion of the gauge. In some of these embodiments, each channel of the plurality may comprise one primary opening. In some of these embodiments, each channel of the plurality of channels may comprise at least one primary opening, e.g., at least two primary openings, at least three primary openings, four primary openings, or at least five primary openings. In some embodiments, the drill bit comprises a primary opening in each channel in which an auxiliary opening is formed.

The nature and structure of the first opening is not particularly limited. In some embodiments, the first opening comprises a port. In some embodiments, the first opening comprises a nozzle. In some embodiments, the drill bit comprises a plurality of first openings, and each first opening comprises a port. In some embodiments, the drill bit comprises a plurality of first openings, and each first opening comprises a nozzle. In some embodiments wherein the drill bit comprises a plurality of first openings, each first opening may independently comprise a port or a nozzle. In the embodiment shown in FIGS. 2A and 2B, for example, the drill bit 200 includes a first opening 240 formed in a portion of the face 210 of each channel 208, and each first opening 240 is formed in a nozzle.

FIG. 3 also depicts the first opening 340. As shown, the central pathway 350 is also connected to a first opening 340 via a first bypath (not illustrated). The first bypath is directed toward the face 310. During drilling, the first bypath is directed toward the direction of drilling and allows the flow of drilling fluid (illustrated by arrows) to the face 310 through the first opening 340.

In some embodiments, the first bypath and/or the second bypath are sized or otherwise designed to control the relative volume of drilling fluid that flows through each. In some embodiments, for example, the first bypath and the second bypath are sized such that a greater volume of drilling fluid flows through the first bypath than through the second bypath. Said another way, during operation, the first bypath provides a first volume of fluid (e.g., the bit face flow area), the second bypath provides a second volume of fluid (e.g., the auxiliary flow area), and in some embodiments, the first volume of fluid is greater than the second volume of fluid. In one embodiment, ratio of the first volume to the second volume is greater than 1, e.g., greater than 1.5, greater than 2, greater than 2.5, greater than 3, or greater than 3.5.

Channels

In various embodiments, the width, the depth, or a combination thereof (width and depth) of one or more channels of the plurality of channels is substantially constant within at least a portion of the one or more channels of the plurality of channels. As described herein, the term "substantially" may be substituted with "within [a percentage] of" what is specified, where the percentage includes 0.1, 1, 5, and 10 percent; and thus "substantially constant" means that the width, the depth, or a combination thereof of the one or more channels remains within 0.1, 1, 5, or 10% throughout the portion of the channels (e.g., the width and/or depth never vary by more than 0.1, 1, 5, or 10% throughout the portion of the channels). In some embodiments, the width, the depth, or a combination thereof of each of the one or more channels is the same or different within the portion of the one or more channels where the width, the depth, or a combination thereof are maintained substantially constant. For example, a first subset of the one or more channels may have a first width, first depth, or combination thereof that remains substantially constant within at least a portion of the first subset of the one or more channels, and a second subset of the one or more channels may have a second width, second depth, or combination thereof that remains substantially constant within at least a portion of the second subset of the one or more channels, where the first width is the same or different as the second width, the first depth is the same or different as the second depth, or a combination thereof. In some embodiments, the width or the depth is substantially constant within at least a portion of the one or more channels of the plurality of channels. In other embodiments, the width and the depth are substantially constant within at least a portion of the one or more channels of the plurality of channels.

In various embodiments, the cross-sectional area of the one or more channels of the plurality of channels is substantially constant within at least a portion of the one or more channels of the plurality of channels. As described herein, the term "substantially" may be substituted with "within [a percentage] of" what is specified, where the percentage includes 0.1, 1, 5, and 10 percent; and thus "substantially constant" means that the cross-sectional area of the one or more channels remains within 0.1, 1, 5, or 10% through-out the portion of the channels (e.g., the cross-sectional area never vary by more than 0.1, 1, 5, or 10% through-out the portion of the channels). In some embodiments, cross-sectional area of each of the one or more channels is the same or different within the portion of the one or more channels where the cross-sectional area is maintained substantially constant. For example, a first subset of the one or more channels may have a first cross-sectional area that remains substantially constant within at least a portion of the first subset of the one or more channels, and a second subset of the one or more channels may have a second cross-sectional area that remains substantially constant within at least a portion of the second subset of the one or more channels, where the first cross-sectional area is the same or different as the second cross-sectional area.

Reduced Erosion

As discussed, the present inventors have found that the inclusion of the second opening in the gauge portion of the drill bit greatly reduces erosion on PDC cutters and/or the face of the drill bit. In doing so, the second opening can improve operation of the drill bit, e.g., by prolonging the operable life of the drill bit or of individual PDC cutters.

Figure 4A:
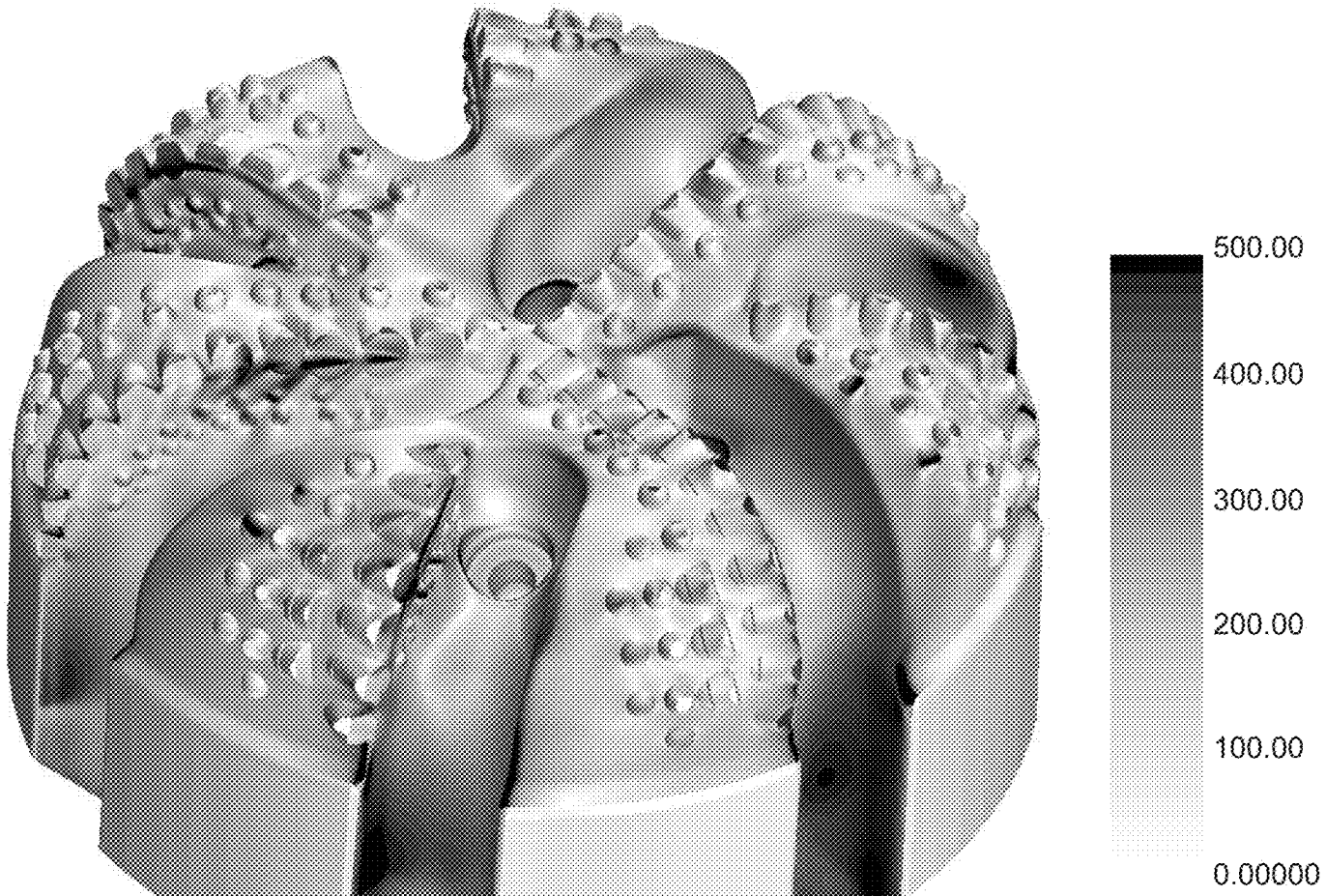
FIG. 4A is a perspective view of a conventional drill bit with a mapping of the velocity of drilling fluid during operation of the drill bit.
Figure 4B:
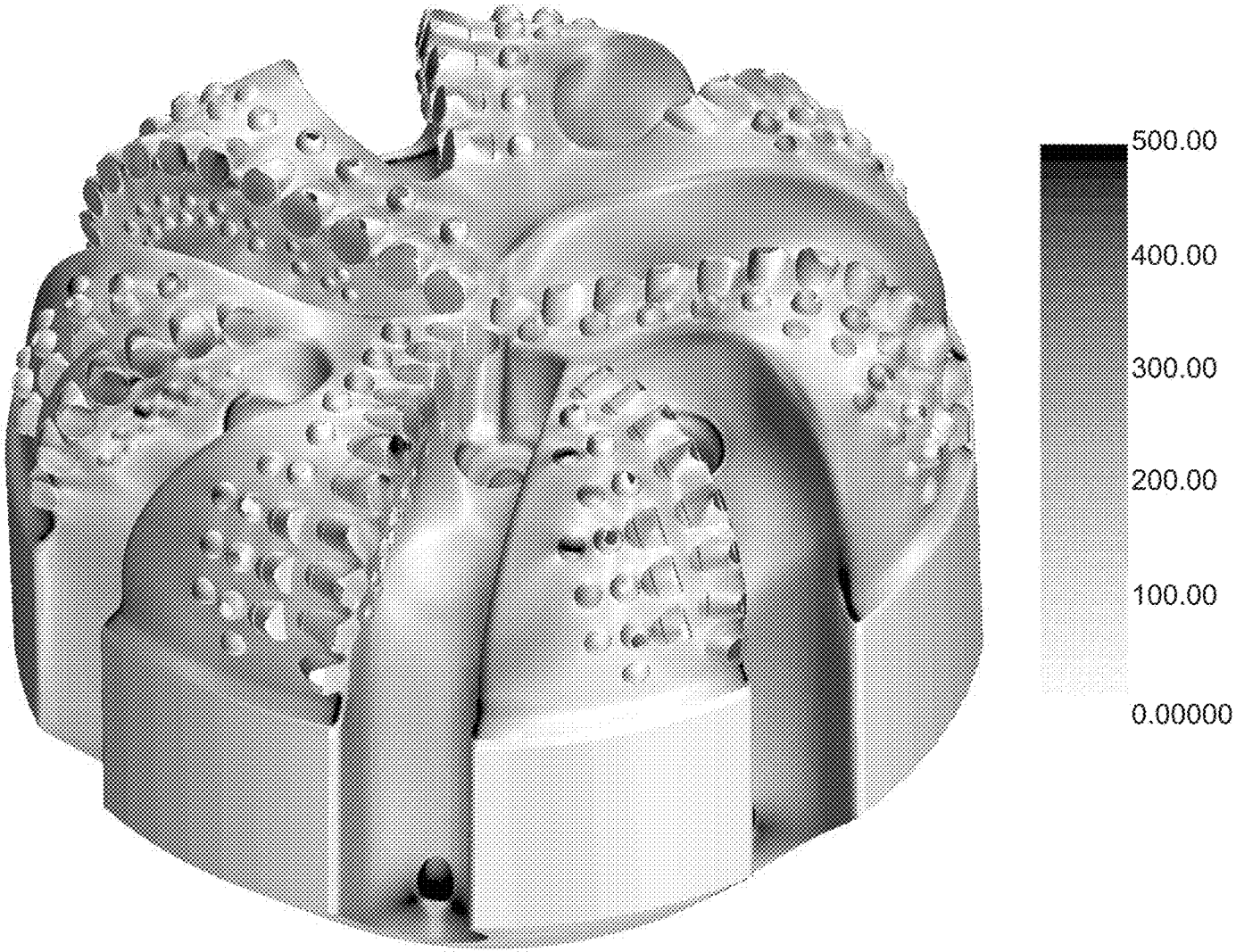
FIG. 4B is a perspective view of a drill bit in accordance with various embodiments of the present disclosure with a mapping of the velocity of drilling fluid during operation of the drill bit.

One aspect of the reduced erosion is depicted in FIGS. 4A and 4B, which illustrate a map of the velocity of drilling fluid flow across the face of a drill bit during operation. FIG. 4A depicts a conventional drill bit, which lacks second openings in the gauge portion of the channel. As FIG. 4A illustrates, the PDC cutters of the conventional drill bit, particularly the first row of PDC cutters, are exposed to drilling fluid flowing at high velocity. FIG. 4B depicts a drill bit which embodies the present disclosure and which includes second openings in the gauge portion of the channel. As can been seen in FIG. 4B, the inclusion of the second openings allows a portion of the drilling fluid to bypass the face of the drill bit. As a result, the PDC cutters are exposed to substantially lower velocity of drilling fluid, reducing the erosion on each PDC cutter.

As a result of the reduced erosion, the PDC cutters of the drill bit described herein advantageously have a longer usable life. In some cases, the usable life of the PDC cutter can be described by the amount of time that the drill bit can be operated without need for replacing a cutter (e.g., due to damage to the cutter support, as described above). In some embodiments, the drill bit can be operated for at least 10 hours without need for replacing a PDC cutter, e.g., at least 12 hours, at least 15 hours, at least 18 hours, at least 20 hours, at least 22 hours, at least 25 hours, at least 30 hours, at least 35 hours, at least 40 hours, at least 45 hours, or at least 50 hours.

EMBODIMENTS

As used below, any reference to a series of embodiments is to be understood as a reference to each of those embodiments disjunctively (e.g., "Embodiments 1-4" is to be understood as "Embodiments 1, 2, 3, or 4").

Embodiment 1 is a drill bit comprising: a body comprising a gauge for engaging a side of a well bore and a face for engaging a bottom of the well bore; a plurality of channels formed in the body, wherein the plurality of channels extend radially along a portion of the face and extend longitudinally along a portion of the gauge; a central pathway formed through the body for providing a fluid to the plurality of channels; a second opening located in at least one of the plurality of channels within the portion of the gauge, wherein the second opening is in fluidic communication with the central pathway through a second bypath; a first opening located in at least one of the plurality of channels within the portion of the face, wherein the first opening is in fluidic communication with the central pathway through a first bypath; and a plurality of blades formed between the plurality of channels, wherein each of the plurality of blades comprise an edge on which is mounted a plurality of cutters arranged for shearing the bottom of the well bore.

Embodiment 2 is the drill bit of embodiment(s) 1, wherein the first opening and/or the second opening comprises a port.

Embodiment 3 is the drill bit of embodiment(s) 1-2, wherein the first opening and/or the second opening is formed in a nozzle.

Embodiment 4 is the drill bit of embodiment(s) 1-3, wherein the first bypath is directed toward the face of the bit and the second bypath is directed away from the face of the bit.

Embodiment 5 is the drill bit of embodiment(s) 1-4, wherein the second bypath is fluidically connected to the central pathway at a first junction, the central pathway has a longitudinal axis, and the second bypath has a longitudinal axis, and wherein an angle of intersection between the longitudinal axis of the central pathway and the longitudinal axis of the second bypath at the first junction is less than 90 degrees.

Embodiment 6 is the drill bit of embodiment(s) 1-5, wherein the second bypath has a longitudinal axis and the at least one of the plurality of channels within the portion of the gauge comprises a bottom wall having a longitudinal axis, and wherein an angle of intersection between the longitudinal axis of the second bypath and the longitudinal axis of the bottom wall at the second opening is less than 90 degrees.

Embodiment 7 is the drill bit of embodiment(s) 1-6, wherein the first opening and the second opening are located in the same channel.

Embodiment 8 is the drill bit of embodiment(s) 1-7, wherein each channel of the plurality the channels comprises a width, a depth, a combination of the width and the depth, or a cross sectional area that is substantially constant within at least a portion of each of the plurality of channels Embodiment 9 is the drill bit of embodiment(s) 8, wherein the width and the depth of each of the plurality of channels remains substantially constant within the portion of each of the plurality of channels.

Embodiment 10 is the drill bit of embodiment(s) 8-9, wherein the cross sectional area of each of the plurality of channels remains substantially constant within the portion of each of the plurality of channels.

Embodiment 11 is a system for drilling a well bore, the system comprising: a drill bit comprising: a body comprising a face for engaging a bottom of the well bore being drilled and a gauge for engaging a side of the well bore being drilled; a plurality of channels formed in the body, wherein the plurality of channels extend radially along a portion the face and extend longitudinally along a portion of the gauge; a central pathway formed through the body for providing a fluid to the plurality of channels a first fluidic path comprising a first opening and a first pathway, wherein the first opening is located in at least one of the plurality of channels within the portion of the face, and wherein the first fluidic path is in fluidic communication with the central pathway; a second fluidic path comprising a second opening and a second pathway, wherein the second opening is located in at least one of the plurality of channels within the portion of the gauge, and wherein the second fluidic path is in fluidic communication with the central pathway; and a fluid source configured to provide the fluid to the first fluidic path and the second fluidic path through the central pathway.

Embodiment 12 is the drill bit of embodiment(s) 11, wherein the first opening and/or the second opening comprises a port.

Embodiment 13 is the drill bit of embodiment(s) 11-12, wherein the first opening and/or the second opening is formed in a nozzle.

Embodiment 14 is the system of embodiment(s) 11-13, wherein the first fluidic path is directed toward the face and the second fluidic path is directed toward the gauge.

Embodiment 15 is the system of embodiment(s) 11-14, wherein the first fluidic path provides a first volume of the fluid, the second fluidic path provides a second volume of the fluid, and the first fluidic path and/or the second fluidic path is structured such that a ratio of the first volume to the second volume is greater than 1.

Embodiment 16 is the system of embodiment(s) 11-15, wherein the fluid comprises drilling mud.

Embodiment 17 is the system of embodiment(s) 11-16, wherein the fluid comprises compressible pneumatic fluid.

Embodiment 18 is the system of embodiment(s) 11-17, wherein the drill bit further comprises: a plurality of blades formed between the plurality of channels, wherein each of the plurality of blades having a leading edge on which is mounted a plurality of PDC cutters; and a plurality of inserts on the plurality of blades, wherein at least some of the plurality of inserts are positioned behind the plurality of PDC cutters, between the leading edge and a trailing edge of each of the plurality of blades.

Embodiment 19 is a method for drilling a well bore through a subterranean formation, the method comprising: rotating a drill bit in the well bore, wherein the drill bit comprises: a body comprising a face for engaging a bottom of the well bore being drilled and a gauge for engaging a side of the well bore being drilled; a plurality of channels formed in the body, wherein the plurality of channels extends radially along a portion the face and extend longitudinally along a portion of the gauge; a plurality of blades formed between the plurality of channels, wherein each of the plurality of blades having a leading edge on which is mounted a plurality of PDC cutters a central pathway formed through the body for providing a fluid to the plurality of channels a first fluidic path comprising a first opening and a first pathway, wherein the first opening is located in at least one of the plurality of channels within the portion of the face, and wherein the first fluidic path is in fluidic communication with the central pathway; and a second fluidic path comprising a second opening and a second pathway, wherein the second opening is located in at least one of the plurality of channels within the portion of the gauge, and wherein the second fluidic path is in fluidic communication with the central pathway; engaging the well bore with the plurality of PDC cutters to form rock cuttings, wherein the rock cuttings fall into the plurality of channels; and pumping the fluid to the first fluidic path and the second fluidic path through the central pathway.

Embodiment 20 is the method of embodiment(s) 19, wherein the first fluidic path is directed toward the direction of drilling and the second fluidic path is directed opposite the direction of drilling.

Embodiment 21 is the method of embodiment(s) 19-20, wherein the first fluidic path provides a first volume of the fluid, the second fluidic path provides a second volume of the fluid, and the first fluidic path and/or the second fluidic path is structured such that a ratio of the first volume to the second volume is greater than 1.

Embodiment 22 is the method of embodiment(s) 19-21, wherein the fluid comprises drilling mud.

Embodiment 23 is the method of embodiment(s) 19-22, wherein the fluid comprises compressible pneumatic fluid.

We claim:

1. A rotary drag drill bit comprising:

a body comprising a gauge for engaging a side of a well bore and a face for engaging a bottom of the well bore, wherein the gauge is contiguous with the face;

a plurality of blades formed on the body, wherein:

each blade of the plurality of blades protrudes from a surface of the body in a continuous manner from a first extreme end of a respective blade to a second extreme end of the respective blade;

each of the plurality of blades comprise an edge on which is mounted a plurality of cutters arranged for shearing the bottom of the well bore; and each of the plurality of blades extends from the face to the gauge;

a plurality of channels formed in the body, each channel of the plurality of channels separating adjacent blades of the plurality of blades, wherein the plurality of channels extend radially along a portion of the face and extend longitudinally along a portion of the gauge;

a central pathway formed through the body for providing a fluid to the plurality of channels, wherein a distal end of the central pathway expands to a plenum having a larger diameter than a medial portion of the central pathway;

a second opening located in at least one of the plurality of channels within the portion of the gauge, wherein the second opening is in fluidic communication with the central pathway through a second bypath, wherein the second bypath extends through a sidewall of the plenum; and a first opening located in at least one of the plurality of channels within the portion of the face, wherein the first opening is in fluidic communication with the central pathway through a first bypath, wherein the first bypath extends through a wall of the plenum.

2. The rotary drag drill bit of claim 1, wherein the first bypath is directed toward the face of the bit and the second bypath is directed away from the face of the bit.

3. The rotary drag drill bit of claim 1, wherein the second bypath is fluidically connected to the central pathway at a first junction, the central pathway has a longitudinal axis, and the second bypath has a longitudinal axis, and wherein an angle of intersection between the longitudinal axis of the central pathway and the longitudinal axis of the second bypath at the first junction is less than 90 degrees.

4. The rotary drag drill bit of claim 1, wherein the second bypath has a longitudinal axis and the at least one of the plurality of channels within the portion of the gauge comprises a bottom wall having a longitudinal axis, and wherein an angle of intersection between the longitudinal axis of the second bypath and the longitudinal axis of the bottom wall at the second opening is less than 90 degrees.

5. The rotary drag drill bit of claim 1, wherein the first opening and the second opening are located in the same channel.

6. The rotary drag drill bit of claim 1, wherein each channel of the plurality the channels comprises at least one substantially constant dimension within at least a portion of each of the plurality of channels, the substantially constant dimension being selected from a group consisting of a width, a depth, a combination of the width and the depth, and a cross sectional area.

7. The rotary drag drill bit of claim 6, wherein the width and the depth of each of the plurality of channels remains substantially constant within the portion of each of the plurality of channels.

8. The rotary drag drill bit of claim 6, wherein the cross sectional area of each of the plurality of channels remains substantially constant within the portion of each of the plurality of channels.

9. The rotary drag drill bit of claim 1, wherein:

the second opening is one of a plurality of second openings, each second opening extending through a different one of the plurality of channels;

the second bypath is one of a plurality of second bypaths, each second bypath extending through the plenum;

the first opening is one of a plurality of first openings, each first opening extending through a different one of the plurality of channels; and the first bypath is one of a plurality of first bypaths, each first bypath extending through the plenum.

10. A system for drilling a well bore, the system comprising:

a rotary drag drill bit comprising:

a body comprising a face for engaging a bottom of the well bore being drilled and a gauge for engaging a side of the well bore being drilled, wherein the gauge is contiguous with the face;

a plurality of blades formed on the body, wherein:

each blade of the plurality of blades protrudes from a surface of the body in a continuous manner from a first extreme end of a respective blade to a second extreme end of the respective blade;

each of the plurality of blades comprise an edge on which is mounted a plurality of cutters arranged for shearing the bottom of the well bore; and each of the plurality of blades extends from the face to the gauge;

a plurality of channels formed in the body, each channel of the plurality of channels separating adjacent blades of the plurality of blades, wherein the plurality of channels extend radially along a portion the face and extend longitudinally along a portion of the gauge;

a central pathway formed through the body for providing a fluid to the plurality of channels, wherein a distal end of the central pathway expands to a plenum having a larger diameter than a medial portion of the central pathway;

a first fluidic path comprising a first opening and a first pathway, wherein the first opening is located in at least one of the plurality of channels within the portion of the face, and wherein the first fluidic path is in fluidic communication with the central pathway and extends through a wall of the plenum;

a second fluidic path comprising a second opening and a second pathway, wherein the second opening is located in at least one of the plurality of channels within the portion of the gauge, and wherein the second fluidic path is in fluidic communication with the central pathway and extends through a sidewall of the plenum, wherein at a junction of the second fluidic path and the central pathway, an angle between the second fluidic path and the central pathway is less than 90 degrees; and a fluid source configured to provide the fluid to the first fluidic path and the second fluidic path through the central pathway.

11. The system of claim 10, wherein the first fluidic path provides a first volume of the fluid, the second fluidic path provides a second volume of the fluid, and the first fluidic path and/or the second fluidic path is structured such that a ratio of the first volume to the second volume is greater than 1.

12. The system of claim 10, wherein the fluid comprises drilling mud.

13. The system of claim 10, wherein the fluid comprises compressible pneumatic fluid.

14. The system of claim 10, wherein the rotary drag drill bit further comprises:

a plurality of inserts on the plurality of blades, wherein at least some of the plurality of inserts are positioned behind the plurality of cutters, between the edge and a trailing edge of each of the plurality of blades.

15. A method for drilling a well bore through a subterranean formation, the method comprising:

rotating a drill bit in the well bore, wherein the drill bit comprises:

a body comprising a face for engaging a bottom of the well bore being drilled and a gauge positioned adjacent the face, the gauge being configured for engaging a side of the well bore being drilled, wherein the gauge is contiguous with the face;

a plurality of blades formed on the body, wherein:

each blade of the plurality of blades protrudes from a surface of the body in a continuous manner from a first extreme end of a respective blade to a second extreme end of the respective blade;

each of the plurality of blades comprise an edge on which is mounted a plurality of cutters arranged for shearing the bottom of the well bore; and each of the plurality of blades extends from the face to the gauge;

a plurality of channels formed in the body, each channel of the plurality of channels separating adjacent blades of the plurality of blades, wherein the plurality of channels extends radially along a portion the face and extend longitudinally along a portion of the gauge;

a central pathway formed through the body for providing a fluid to the plurality of channels, wherein a distal end of the central pathway expands to a plenum having a larger diameter than a medial portion of the central pathway;

a first fluidic path comprising a first opening and a first pathway, wherein the first opening is located in at least one of the plurality of channels within the portion of the face, and wherein the first fluidic path is in fluidic communication with the central pathway and extends through a wall of the plenum; and a second fluidic path comprising a second opening and a second pathway, wherein the second opening is located in at least one of the plurality of channels and between at least two of the plurality of blades within the portion of the gauge, and wherein the second fluidic path is in fluidic communication with the central pathway, wherein the second fluidic path extends through a sidewall of the plenum;

engaging the well bore with the plurality of cutters to form rock cuttings, wherein the rock cuttings fall into the plurality of channels; and pumping the fluid to the first fluidic path and the second fluidic path through the central pathway.

16. The method of claim 15, wherein the first fluidic path is directed toward the direction of drilling and the second fluidic path is directed opposite the direction of drilling.

17. The method of claim 15, wherein the first fluidic path provides a first volume of the fluid, the second fluidic path provides a second volume of the fluid, and the first fluidic path and/or the second fluidic path is structured such that a ratio of the first volume to the second volume is greater than 1.

18. The method of claim 15, wherein the fluid comprises drilling mud.

19. The method of claim 15, wherein the fluid comprises compressible pneumatic fluid.

* * * * *